US008534016B2

(12) United States Patent
DePaul

(10) Patent No.: US 8,534,016 B2
(45) Date of Patent: Sep. 17, 2013

(54) CORNER WALL CONDUIT

(76) Inventor: Robert DePaul, Red Bank, NJ (US)

( * ) Notice: Subject to any disclaimer, the term of this patent is extended or adjusted under 35 U.S.C. 154(b) by 0 days.

(21) Appl. No.: 12/709,582

(22) Filed: Feb. 22, 2010

(65) Prior Publication Data

US 2010/0242388 A1 Sep. 30, 2010

Related U.S. Application Data

(63) Continuation-in-part of application No. 12/383,936, filed on Mar. 30, 2009, now abandoned.

(51) Int. Cl.
*E04B 2/00* (2006.01)
*E04C 2/38* (2006.01)

(52) U.S. Cl.
USPC ..... 52/288.1; 52/718.04; 52/716.8

(58) Field of Classification Search
USPC ..... 52/716.8, 718.01–718.03, 287.1, 52/288.1
See application file for complete search history.

(56) References Cited

U.S. PATENT DOCUMENTS

| | | | | | |
|---|---|---|---|---|---|
| 2,541,768 | A | * | 2/1951 | Keller | 52/287.1 |
| 2,996,751 | A | * | 8/1961 | Roby et al. | 16/7 |
| 3,060,530 | A | * | 10/1962 | Harvey | 52/27 |
| 3,302,350 | A | * | 2/1967 | Brown et al. | 52/288.1 |
| 3,707,061 | A | * | 12/1972 | Collette et al. | 52/288.1 |
| 4,150,517 | A | * | 4/1979 | Warner, Sr. | 52/288.1 |
| 4,430,833 | A | * | 2/1984 | Balzer et al. | 52/255 |
| 4,452,021 | A | * | 6/1984 | Anderson | 52/506.07 |
| 4,534,147 | A | * | 8/1985 | Cristell | 52/288.1 |
| 4,742,662 | A | * | 5/1988 | Smith | 52/718.01 |
| 4,837,998 | A | * | 6/1989 | Roth | 52/288.1 |
| 5,179,811 | A | * | 1/1993 | Walker et al. | 52/288.1 |
| 5,336,849 | A | * | 8/1994 | Whitney | 174/72 C |
| 5,359,817 | A | * | 11/1994 | Fulton | 52/288.1 |
| 5,406,762 | A | * | 4/1995 | Buard | 52/287.1 |
| 5,651,224 | A | * | 7/1997 | Brabant | 52/288.1 |
| 5,662,753 | A | * | 9/1997 | Loos | 156/71 |
| 5,711,123 | A | * | 1/1998 | Lamont et al. | 52/287.1 |
| 5,890,267 | A | * | 4/1999 | Neuhofer, Jr. | 24/295 |
| 6,134,854 | A | * | 10/2000 | Stanchfield | 52/480 |
| 6,323,421 | B1 | * | 11/2001 | Pawson et al. | 174/503 |
| 6,557,311 | B1 | * | 5/2003 | Mongelli | 52/288.1 |
| 6,727,427 | B1 | * | 4/2004 | Gutman | 174/492 |
| 6,916,986 | B1 | * | 7/2005 | Herzog et al. | 174/480 |
| 7,210,272 | B2 | * | 5/2007 | Friday | 52/288.1 |
| 7,908,806 | B2 | * | 3/2011 | Kaplan | 52/287.1 |
| 2007/0251167 | A1 | * | 11/2007 | Kaplan | 52/287.1 |
| 2009/0064613 | A1 | * | 3/2009 | Ouyang et al. | 52/288.1 |
| 2011/0179733 | A1 | * | 7/2011 | Picken | 52/242 |

FOREIGN PATENT DOCUMENTS

| | | | | |
|---|---|---|---|---|
| DE | 3928721 | C1 | * | 11/1990 |
| EP | 227342 | A2 | * | 7/1987 |
| GB | 2191518 | A | * | 12/1987 |
| JP | 06248771 | A | * | 9/1994 |

* cited by examiner

*Primary Examiner* — Joshua J Michener
*Assistant Examiner* — Elizabeth A Plummer
(74) *Attorney, Agent, or Firm* — Arthur M. Peslak; Gertner Mandel & Peslak, LLC

(57) ABSTRACT

What is disclosed is a conduit for the installation of telephone or television cables in the interior of a building. The conduit is adapted to be installed at the corner where a wall meets a ceiling. The conduit comprises a cable receiver, a cover therefore and a molding to be installed over the cover.

1 Claim, 12 Drawing Sheets

CORNER WALL CONDUIT

PRIORITY CLAIM

This application is a continuation-in-part of co-pending U.S. application Ser. No. 12/383,936 filed Mar. 30, 2009.

BACKGROUND OF THE INVENTION

The present invention is directed to the field of conduits used for installation of wires or cables inside of buildings. Such wires or cables can be used for providing telephone, internet, fibre optics, speakers or television service to a customer in a building without having to wall fish wires. In particular, the present invention is directed to the field of conduits mounted on the exterior surface of interior walls in the buildings.

In general, the utility company provides a main line for service into the building. In an apartment or office complex, the service lines to the individual units must be run separately into the individual units. Consequently, the lines are run through various parts of the buildings. Generally, the cables run through the interior hallways in conduits located in the corner where the side walls meet the ceilings. The conduit covers must be easily removable to service, upgrade and to splice the cables when each customer calls for service.

The presently available conduits for use in these types of buildings generally are mounted at the corner where the walls intersect the ceiling. The available conduits generally are fabricated from plastic with a triangular cross-section. Thus, the currently available conduits provide a plain and inexpensive looking appearance. This inexpensive looking appearance creates a problem in up-scale residences and office buildings because it detracts from the ambiance of the building. In such up-scale buildings, the occupants expect high quality appearing mouldings at the corners of walls and ceilings. However, placing a conventional corner moulding over the available conduits cannot be easily implemented.

A primary object of the present invention is to solve the aforementioned problem. The present invention, as explained in detail below, solves this problem by providing a novel corner conduit and moulding combination for installing wires and cables therein. The interchangeable architectural face piece also allows for ease of installation for the typical homeowner. Pre-finished mouldings can be installed without nails or putty eliminating the need to nail through the pre-finished face plate. The product is also UL® rated and may be used as a path for electrical wiring.

SUMMARY OF THE INVENTION

A wall cable conduit combination comprising of a longitudinally extending cable receiver adapted to be fastened to a wall where the wall intersects a ceiling comprising a rear central panel, a first side panel projecting from an end of the rear central panel, a second side panel projecting from an opposite end of the rear central panel, a first semi-circular receiving slot attached to an end of the first side panel opposite to the rear central panel and a second semi-circular receiving slot attached to an end of the second side panel opposite the rear central panel, a longitudinally extending conduit cover adapted to be removeably connected to the cable receiver such that a hollow space is formed between the conduit cover and the cable receiver wherein cables are placed, the conduit cover comprising a longitudinally extending panel with a front and back, a first side edge and a second side edge and a first longitudinally extending connecting unit attached to the first side edge of the panel on the front of the panel and a second longitudinally extending connecting unit attached to the second edge of the panel on the front of the panel and a longitudinally extending rectangular projection on the back of the panel wherein the first connecting unit and the second connecting unit comprise a generally circular projection with a longitudinal slot therein and are adapted to be received in the first and second semi-circular receiving slots, a longitudinally extending decorative moulding comprising a removeable architectural face plate on a front surface wherein the longitudinally extending slot is and a longitudinally extending slot on a back surface where the longitudinally extending slot is adapted to receive the rectangular projection, a double sided tape disposed between the decorative moulding and conduit cover to fix the decorative moulding to the conduit cover.

DETAILED DESCRIPTION OF THE INVENTION

Figure 1:
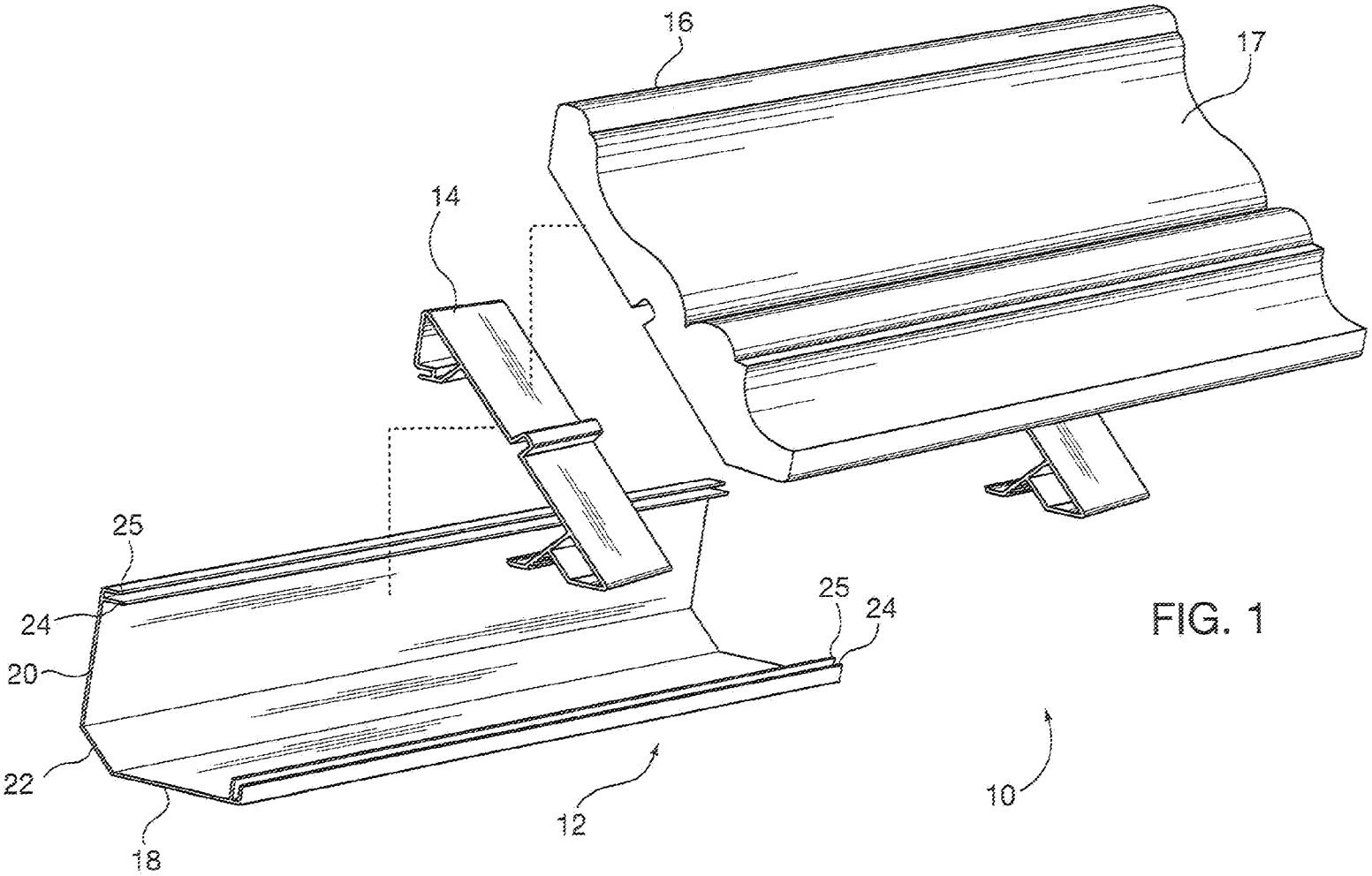
FIG. 1 is a front exploded view of an embodiment of the present invention.

The present invention will now be described in terms of the presently preferred embodiment thereof as illustrated in the drawings. Those of ordinary skill in the art will recognize that many obvious modifications may be made thereto without departing from the spirit or scope of the present invention.

The corner conduit 10 is shown in the drawings. The corner conduit 10 comprises a generally hollow longitudinally extending cable receiver 12, a longitudinally extending conduit cover 14 and a moulding 16. The moulding 16 comprises a front ornamental surface design 17. The ornamental surface design 17 shown in the appended drawings is merely one example of the ornamental surface features of the moulding 16 that could be used as an interchangeable face plate on the cable receiver 12. The corner conduit 10 will be UL® rated and may be used as a path for electrical wiring.

Figure 3:
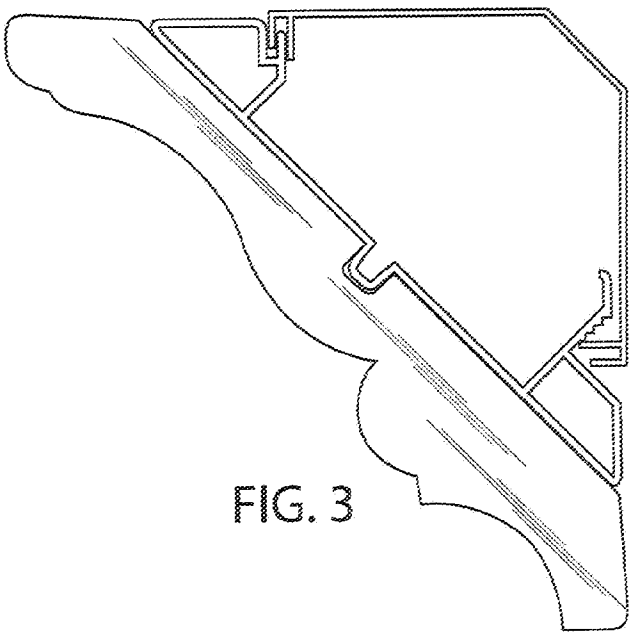
FIG. 3 is a side cut-away assembled view of the present invention.
Figure 2:
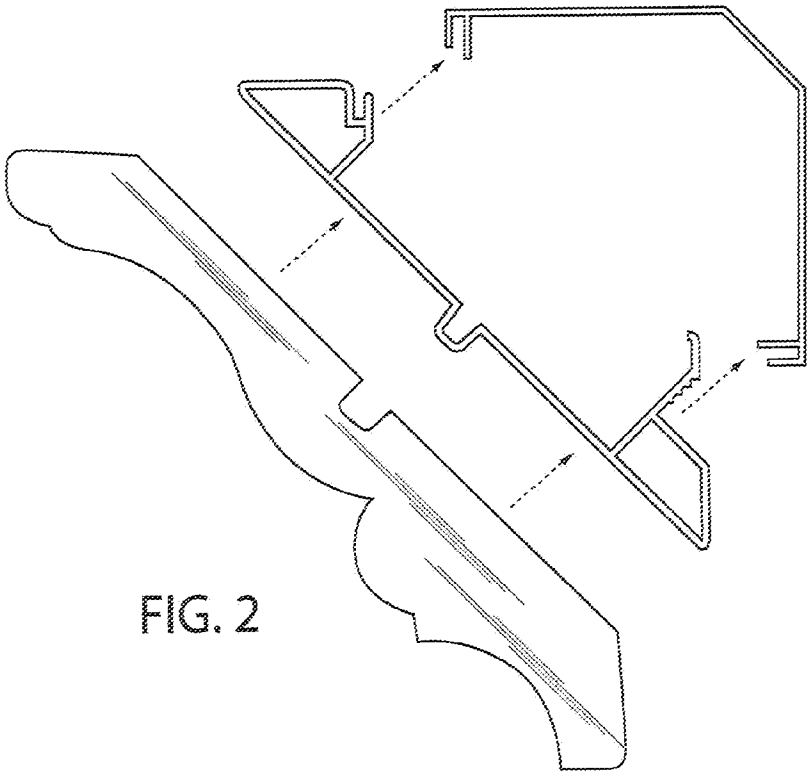
FIG. 2 is a side cut-away exploded view of the present invention.
Figure 4:
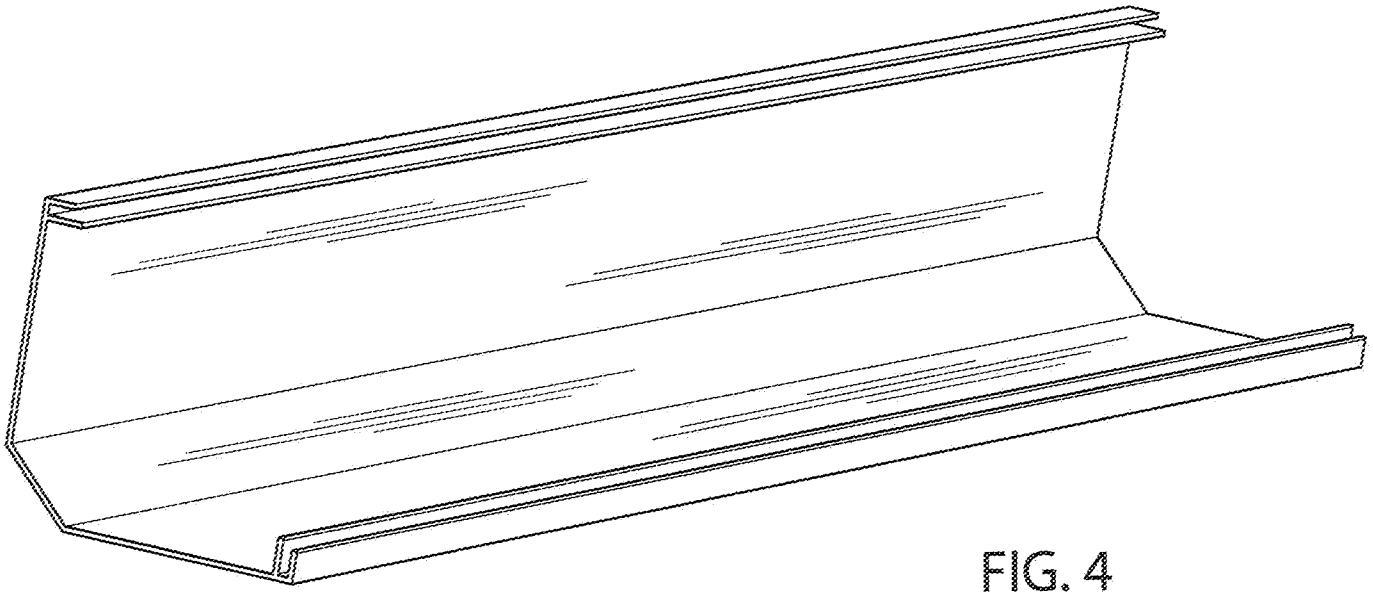
FIG. 4 is a front perspective view of a part of the present invention.
Figure 6:
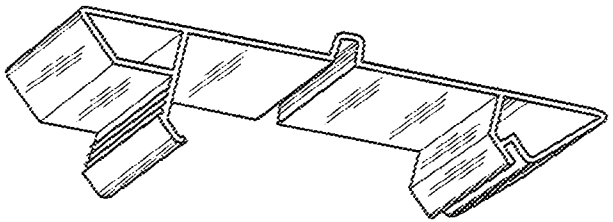
FIG. 6 is a bottom perspective view of a part of the present invention as installed.
Figure 5:
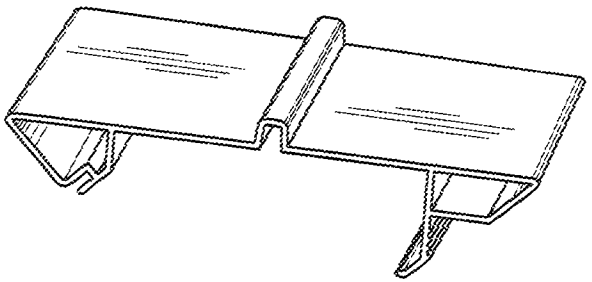
FIG. 5 is a top perspective view of a part of the present invention.

The cable receiver 12 is illustrated in cross-section in FIGS. 2 and 3. The cable receiver 12 comprises two side panels 18 and 20, generally oriented perpendicular to each other, with an integral back panel 22. The cable receiver 12 is adapted to be installed in a corner where a side wall meets a ceiling with the side panel 20 adjacent to the ceiling and the side panel 18 adjacent to the side wall. The cable receiver 12 is generally attached to the wall and ceiling by means of conventional fastening techniques, such as screws, well known to those of ordinary skill in the art. The cable receiver 12 further comprises projections 24 and 25. The projections 24 and 25 are generally oriented perpendicular to the side panel 18 and 20 as shown in FIG. 2.

The conduit cover 14 will now be described in detail. The conduit cover 14 is adapted to snap into the cable receiver 12 as shown in the assembled view of FIG. 3. The conduit cover 14 comprises a central panel 26, a first connecting unit 28 and a second connecting unit 30. It is anticipated that the conduit cover 14 and moulding 16 may be manufactured as an integral extruded plastic part but that is not required to be within the spirit or scope of the present invention.

The central panel 26 is flat with a first rectangular projection 27. The first connecting unit 28 extends from the central panel 26 on one side opposite to the second connecting unit 30. The first connecting unit 28 comprises a rectangular mating unit 29 which is adapted to be received in projections 24 and 25 on the side panel 20.

The second connecting unit 30 comprises a straight projection 31 with a second projection 32 extending therefrom at an angle "a." In addition, the straight projection 31 comprises a plurality of serrated longitudinal grooves 34.

The rectangular projection 27 on central panel 26 is adapted to be received into a mating opening 36 on moulding 16 placed on the surfaces 40 and 42. The moulding 16 snaps in place over the central panel 26 and is joined thereto by double sided tape 38. The double sided tape 38 allows the moulding 16 to be fitted to the conduit cover without the use of nails or putty or other traditional fastening means. The final assembly of the conduit receiver 12, conduit cover 14 and moulding 16 is placed on the surfaces 40 and 42 as shown in FIG. 7.

Figure 7:
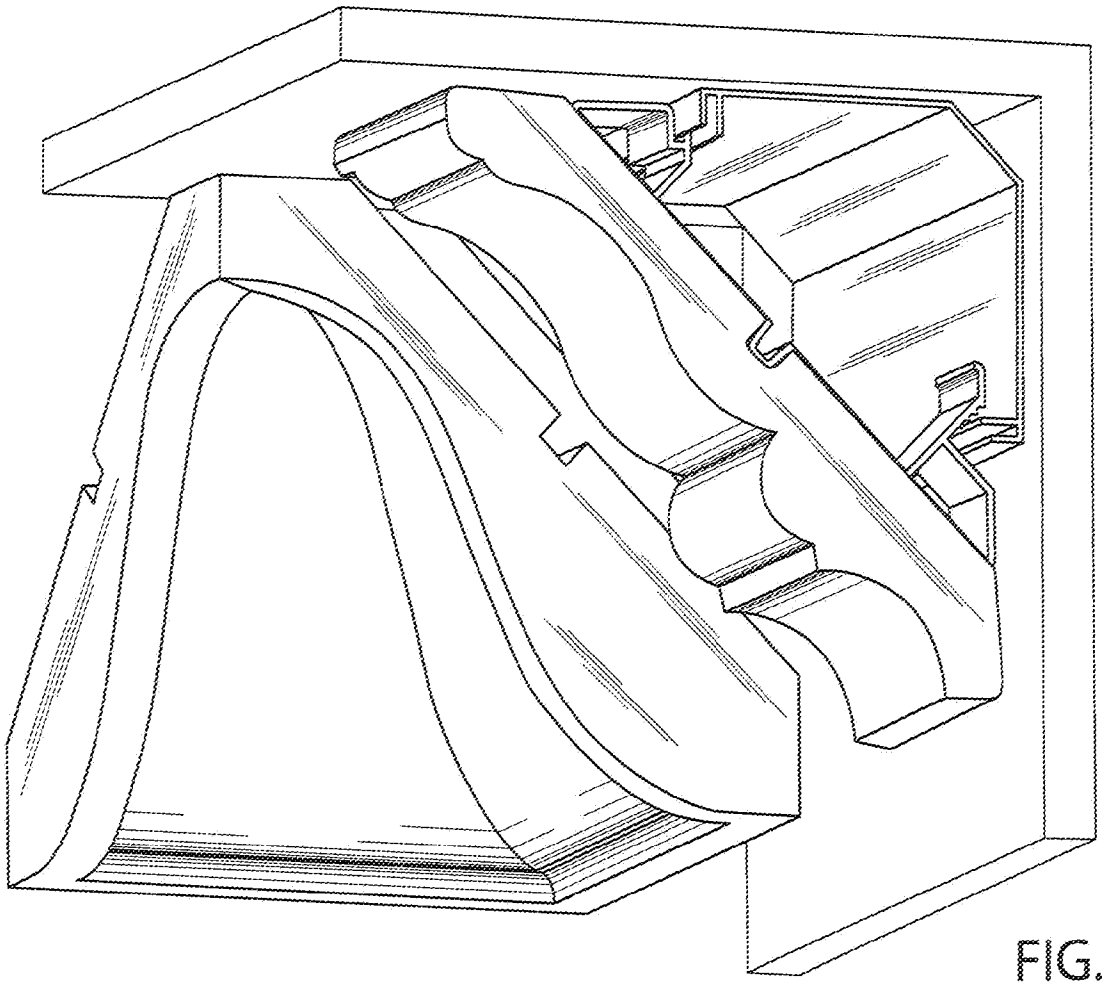
FIG. 7 is an assembled view of an embodiment of the present invention.
Figure 9:
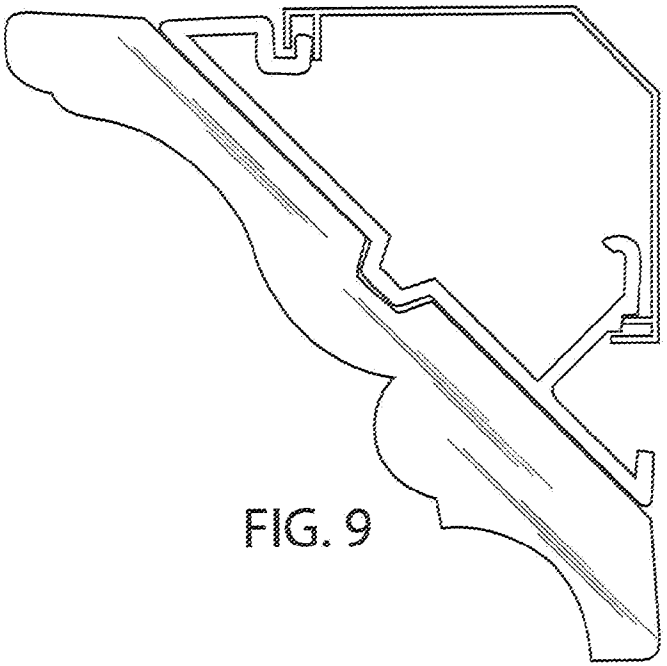
FIG. 9 is a side cut-away assembled view of the present invention.
Figure 8:
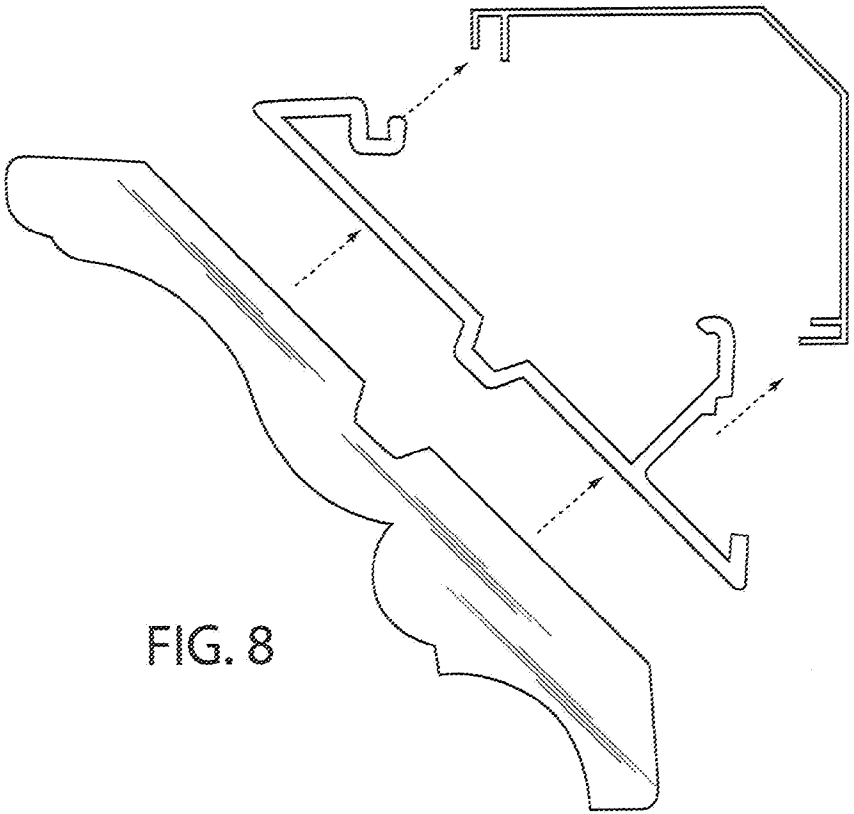
FIG. 8 is an exploded side view of an alternate embodiment of the present invention.
Figure 11:
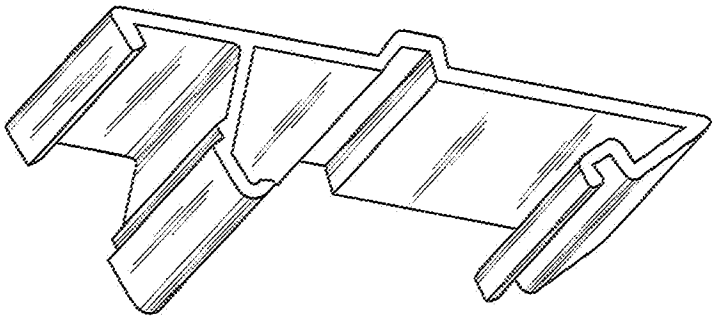
FIG. 11 is a bottom perspective view of an alternate embodiment of the present invention.
Figure 10:
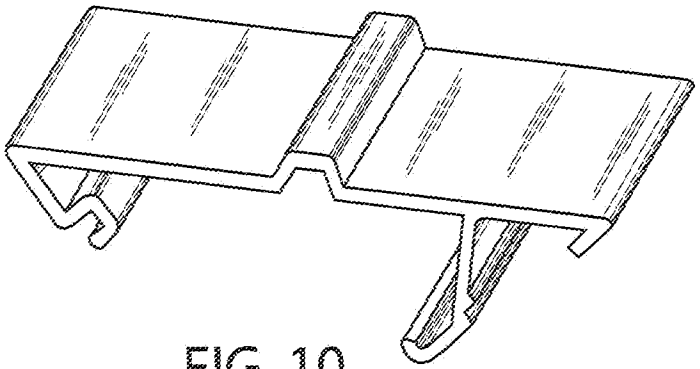
FIG. 10 is a top perspective view of an alternate embodiment of the present invention.

FIG. 7 illustrates the installation of the present invention in a corner where two side walls meet the ceiling. In the case of such a corner, an additional moulding 44 is required. As shown in FIG. 7, the corner conduit 10 is installed along the wall and ceiling joint in both directions. The corner moulding 40 is adapted to fit over the corner conduits 10 by installation on the rectangular projection on the central panel 26.

The installation and use of the corner conduit 10 will now be described in detail. The cable receiver 12 will first be installed at the corner between a wall and ceiling by conventional fastening techniques. The cables or wires will then be installed in the opening 19 formed by side panels 18 and 20. The conduit cover 14 will be snapped into place over the cable receiver 12. The conduit cover 14 will be installed by placing rectangular mating unit 29 into the projections 24 and 25 on side panel 20 and then the opposite end of the conduit cover will be snapped onto projection 25 on side panel 18 until the serrated grooves 34 connect to the corner conduit 12. At that point, the moulding 16 will be snapped onto the front connector 16 and connected thereby the double sided tape as described above. The installation is complete and appears as a normal moulding in the corner between the wall and ceiling.

FIG. 7 illustrates the installation of the corner piece 40. The corner piece 40 comprises two grooves 46 in the same shape as mating opening 36 on the moulding 16. The grooves 46 allow the corner piece 40 to be installed with double sided tape over the corner conduit 10 in the same manner as the moulding 16 allowing for a transition at wall corners.

An alternate embodiment 200 of the present invention is illustrated in FIGS. 12 to 18. The alternate embodiment illustrated in FIGS. 12 to 18 is a simplified version of the prior embodiments that can be utilized by an individual homeowner to install cables in their home or apartment. Unlike the prior embodiment, this embodiment is directed to an initial installation of the cable conduit rather then as an add-on to existing cable conduits. This conduit is a multi-use UL® rated conduit that can be used with electrical wires, speaker wires, etc.

Figure 12:
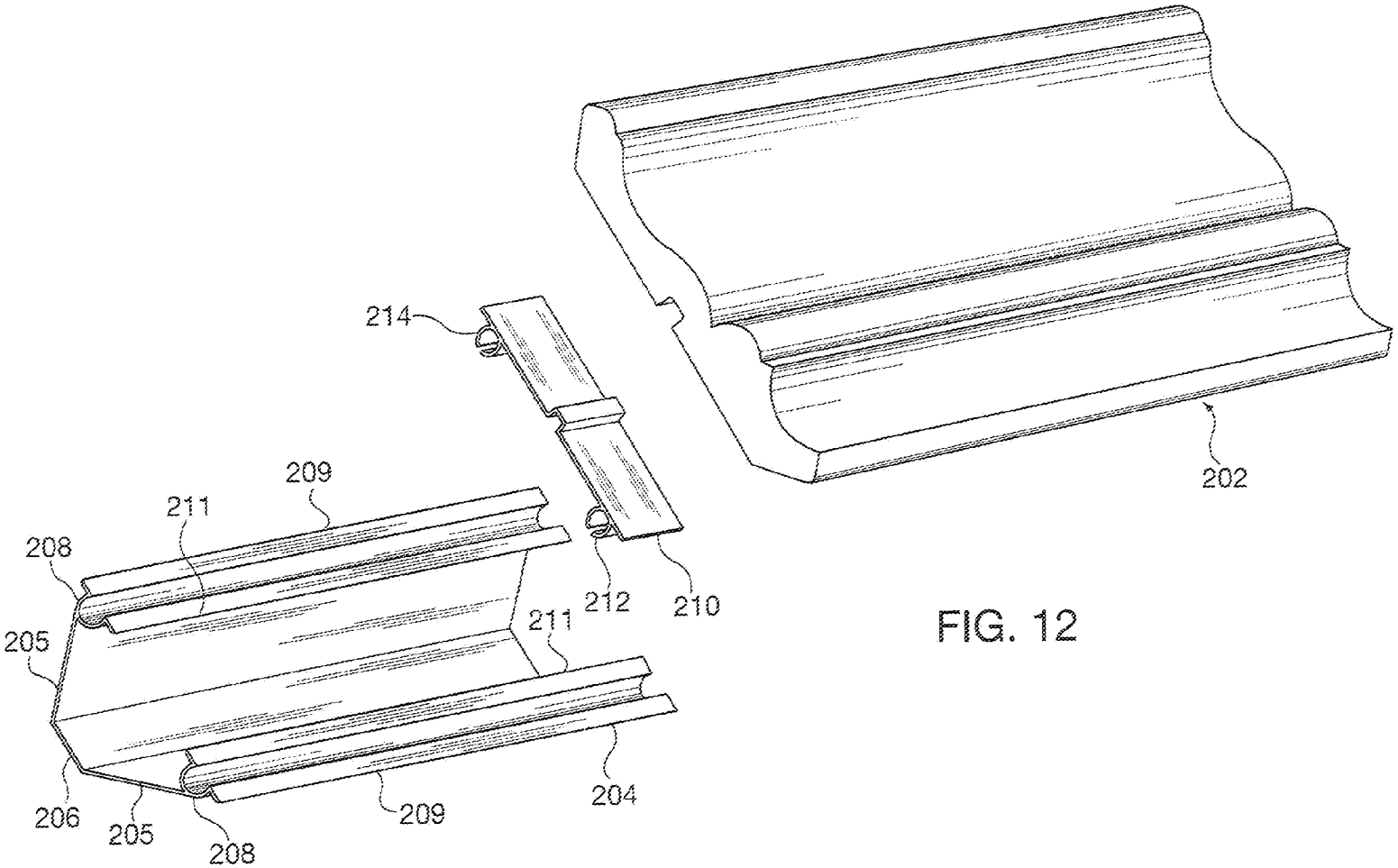
FIG. 12 is a front exploded view of an alternate embodiment of the present invention.

The corner conduit 200 comprises an ornamental moulding 202. The ornamental features on the front of the moulding 202 can be varied without deviating from the scope of the present invention. As shown in FIG. 12, a longitudinally extending cable receiver 204 is provided. The longitudinally extending cable receiver 204 is comprised of two side panels 205, a rear central panel 206 and two semi-circular receiving slots 208 with projections 209 and 211.

Figure 14:
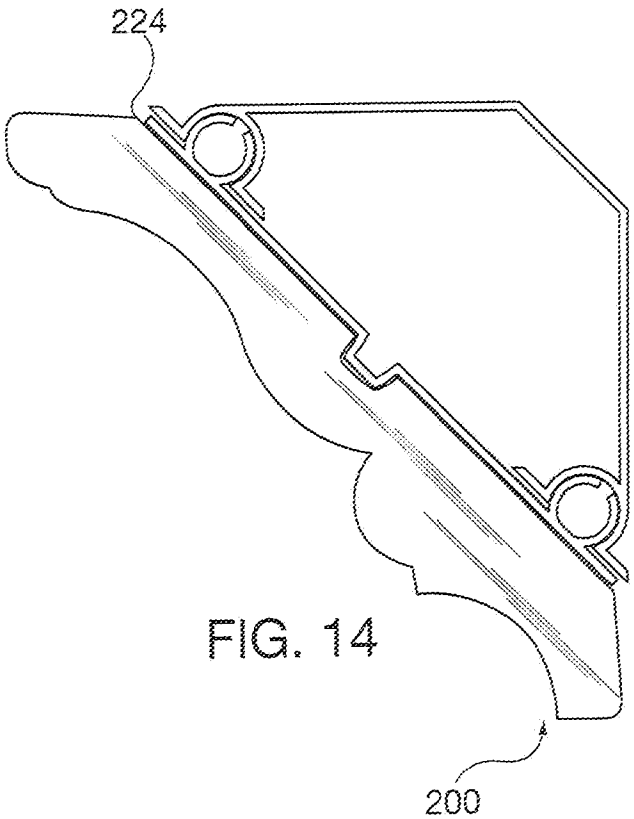
FIG. 14 is a side cut-away assembled view of the alternate embodiment illustrated in FIG. 12.
Figure 13:
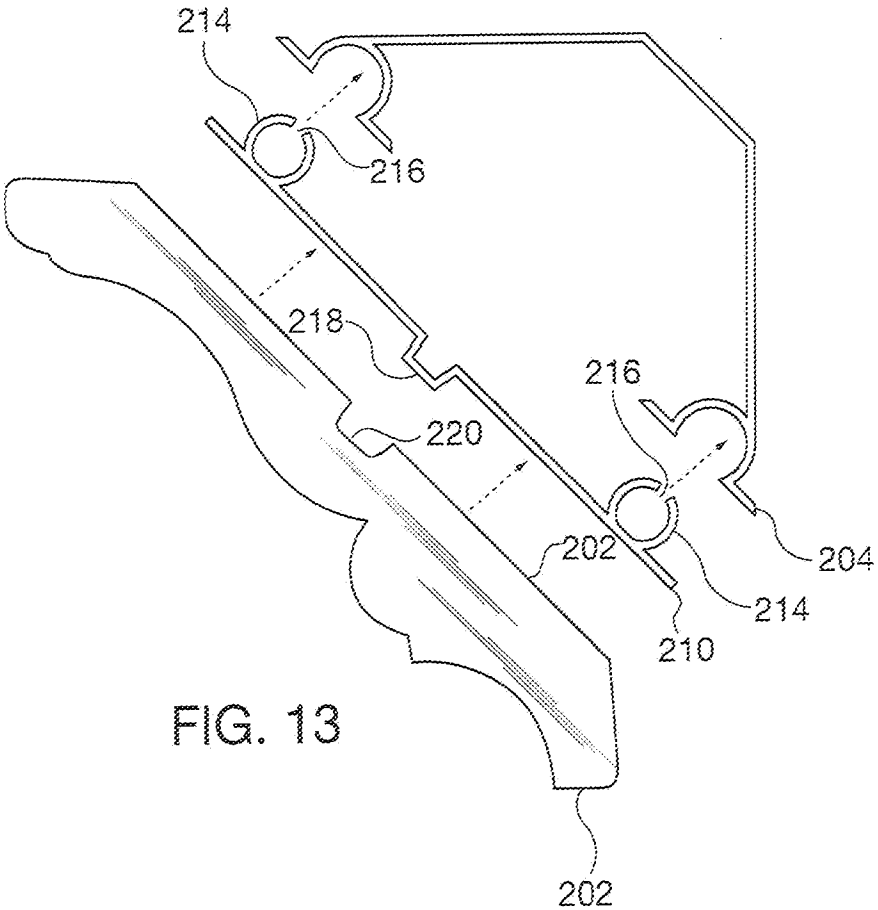
FIG. 13 is a side cut-away exploded view of the alternate embodiment illustrated in FIG. 12.
Figure 15:
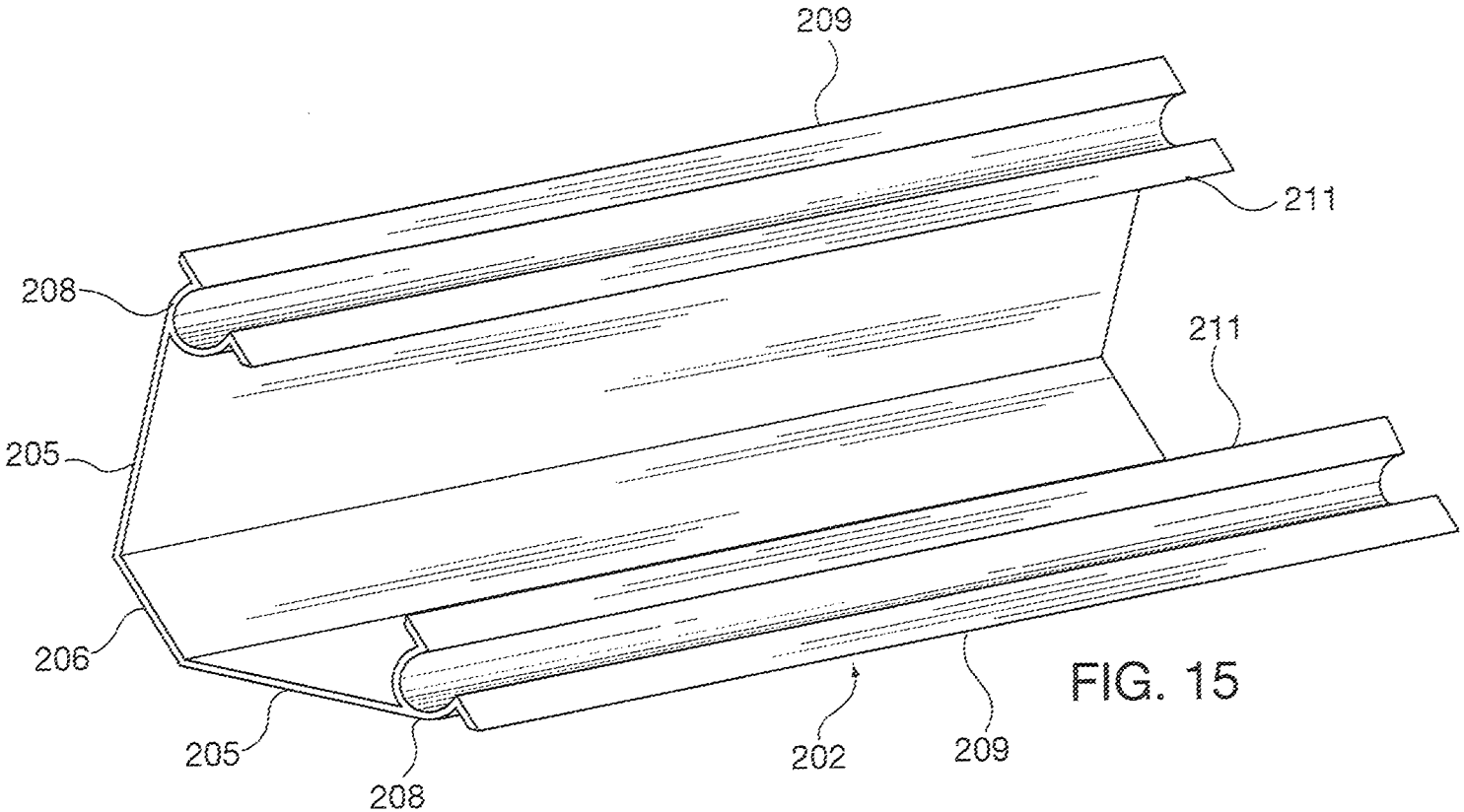
FIG. 15 is a perspective view of a component of the alternate embodiment illustrated in FIG. 12.
Figure 17:
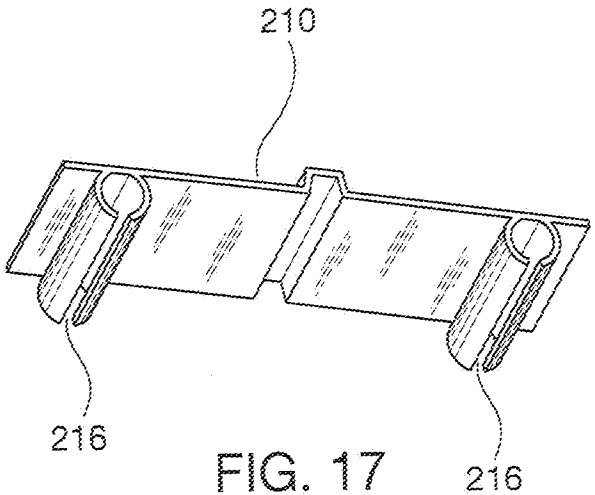
FIG. 17 is a bottom perspective view of a component of the alternate embodiment illustrated in FIG. 12.
Figure 16:
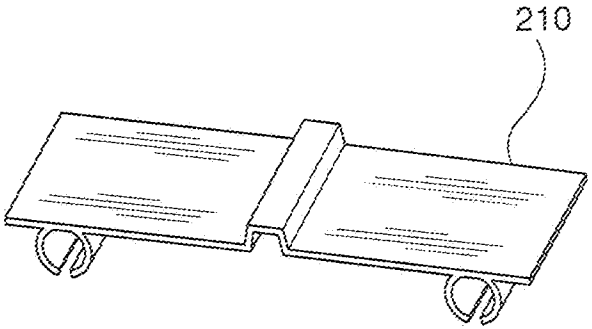
FIG. 16 is a top perspective view of a component of the alternate embodiment illustrated in FIG. 12.
Figure 18:
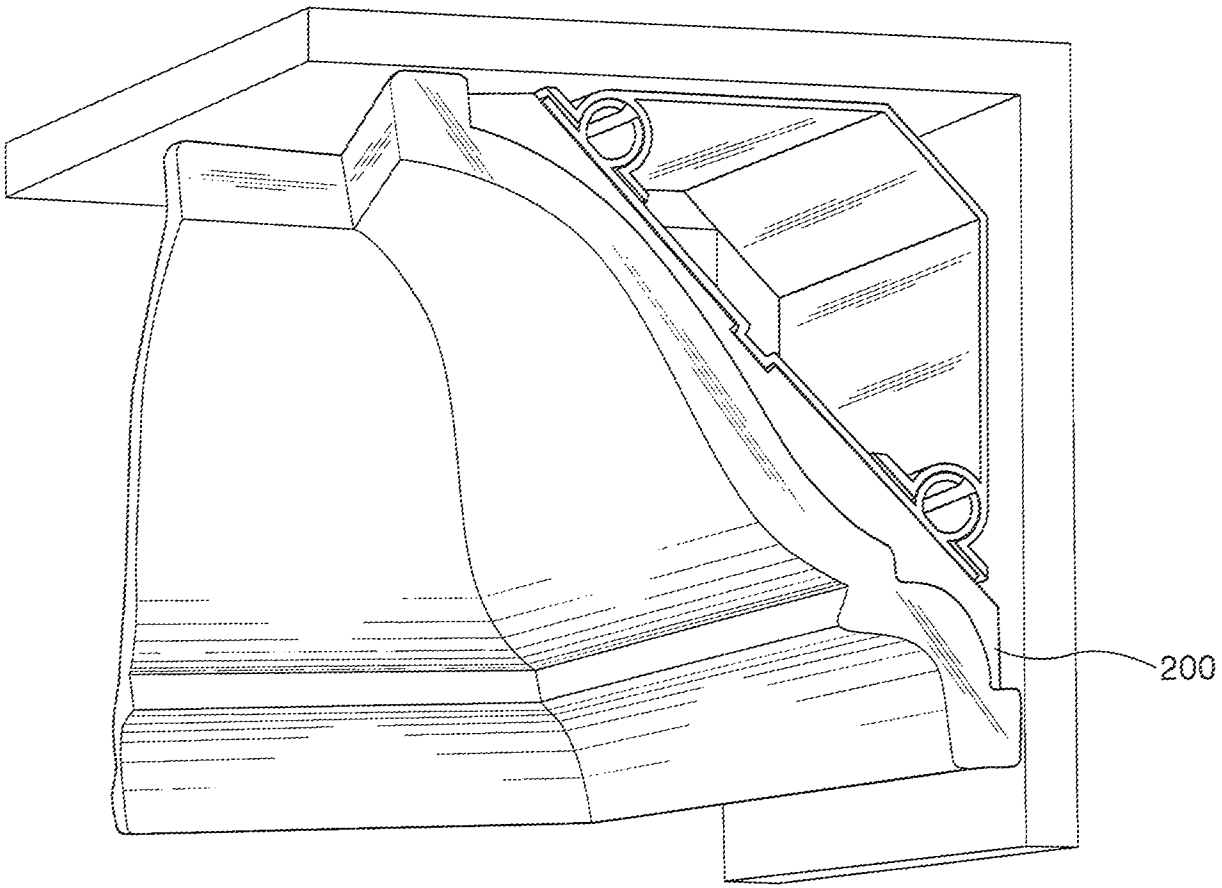
FIG. 18 is an assembled view of the alternate embodiment illustrated in FIG. 12.

The corner conduit 200 further comprises a conduit cover 210. The conduit cover 210 is adapted to snap into the cable receiver 204 as illustrated in FIGS. 13 and 14. The conduit cover 210 comprises a first generally circular connecting unit 212 and a second generally circular connecting unit 214. The circular connecting units 212 and 214 each respectively comprise a longitudinal slot 216. The conduit cover 210 further comprises a longitudinally extending generally rectangular projection 218.

The assembly of the corner conduit 200 is illustrated in FIG. 13. The conduit cover 210 snaps into the conduit receiver 204 by means of the first and second circular connecting units 212 and 214. In practice, the longitudinal slots 216 allow the diameter of the first and second connecting units 212 and 214 to be reversibly contracted a slight amount and then placed into the receiving slots 208. Upon release of the slots 216, the first and second connecting units 212 and 214 expand to their original diameter and into the receiving slots 208 and thereby the conduit cover 210 is fixed to the conduit receiver 204.

The ornamental moulding 202 comprises a generally rectangular longitudinal slot 220 on its rear surface 222. The longitudinal slot 220 is adapted to slidingly receive the generally rectangular projection 218 on the conduit cover 210 as illustrated in FIG. 14. The ornamental moulding 202 is joined to the conduit cover by means of double-sided tape 224 placed between the conduit cover 210 and the ornamental moulding 202, as shown in FIG. 14, to create the final assembly of the corner conduit 220.

Those of ordinary skill in the art will recognize that many obvious modifications may be made thereto without departing from the spirit or scope of the present invention as set forth in the appended claims.

What is claimed is:

1. A corner wall cable conduit combination comprising:

(a) a longitudinally extending cable receiver adapted to be fastened to a wall where the wall intersects a ceiling comprising a rear central panel, a first side panel projecting from an end of the rear central panel, a second side panel projecting from an opposite end of the rear central panel, such that the first side panel and the second side panel are oriented perpendicular to each other, a first semi-circular receiving slot attached to an end of the first side panel opposite to the rear central panel and a second semi-circular receiving slot attached to an end of the second side panel opposite the rear central panel wherein the first side panel is adapted to be received in contact with the wall and the second side panel is adapted to be mounted in contact with the ceiling;

(b) a longitudinally extending conduit cover adapted to be removeably connected to the cable receiver such that a hollow space is formed between the conduit cover and the cable receiver wherein cables are placed, the conduit cover comprising a longitudinally extending panel with a front and back, a first side edge and a second side edge and a first longitudinally extending connecting unit attached to the first side edge of the longitudinally extending panel on the front of the longitudinally extending pane and a second longitudinally extending connecting unit attached to the second edge of the longitudinally extending panel on the front of the longitudinally extending panel and a longitudinally extending rectangular projection on the back of the panel wherein the first connecting unit and the second connecting unit comprise a generally circular projection with a longitudinal slot on the extension of the projection and are adapted to be received in the first and second semi-circular receiving slots and the longitudinal slot allows for contraction and expansion so that the generally circular projections are received on the interior of the first and second semi-circular receiving slots thereby forming a secure connection and wherein when the conduit cover is connected to the cable receiver the combination is a generally triangular shape so that the combination can be installed at the intersection of the wall and the ceiling;

(c) a longitudinally extending decorative molding comprising a removable architectural face plate on a front surface wherein a longitudinally extending slot is on a back surface where the longitudinally extending slot is adapted to receive the rectangular projection; double sided tape disposed between the decorative molding and conduit cover to fix the decorative molding to the conduit cover; and wherein the generally triangular shape of the combination is adapted so that two corner wall cable conduit combinations meet in the corner of the walls and are capped therein with a corner piece of covering molding and the corner piece comprises a slot on a rear side so the corner piece can receive the rectangular projection on the longitudinally extending panel.

* * * * *